US006099041A

United States Patent [19]

Carter

[11] Patent Number: 6,099,041

[45] Date of Patent: Aug. 8, 2000

[54] BODY MOUNTED SAIL ASSEMBLY

[76] Inventor: Robert L. Carter, 3124 Brossman Ct., Naperville, Ill. 60564

[21] Appl. No.: 09/164,521

[22] Filed: Sep. 30, 1998

[51] Int. Cl.[7] ..... A63C 11/00

[52] U.S. Cl. ..... 280/810

[58] Field of Search ..... 280/810, 213, 280/1.5; D12/322; 244/130; 114/102, 103

[56] References Cited

U.S. PATENT DOCUMENTS

| | | | |
|---|---|---|---|
| 4,473,022 | 9/1984 | Eastland | 114/103 |
| 4,634,136 | 1/1987 | Alexander | 280/213 |
| 4,669,407 | 6/1987 | Cobb | 114/39.1 |
| 5,071,089 | 12/1991 | Fagan | 244/16 |
| 5,713,603 | 2/1998 | Carter | 280/810 |

*Primary Examiner*—Kevin Hurley
*Attorney, Agent, or Firm*—Dillis V. Allen, Esq.

[57] ABSTRACT

A human body sail assembly including a rotatable mast with upper and lower horizontal sail braces or booms that swing with the mast. The sail is tensioned by the braces and can be locked in a desired angular position by user-operated frusto-conical mating gearing coaxial with the mast. The braces can separate from the mast for safety if the user falls, and the sail can be collapsed in a compact envelope by swinging the braces toward one another adjacent the skater's back.

21 Claims, 6 Drawing Sheets

Fig. 1
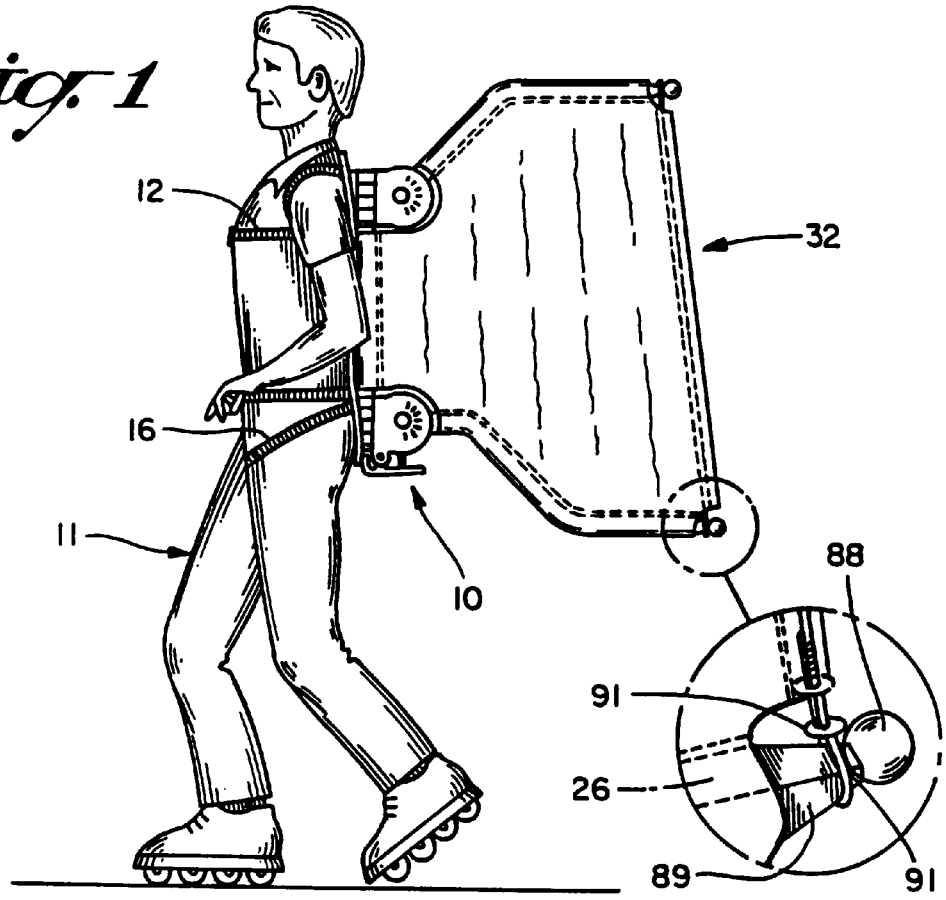
Fig. 1a
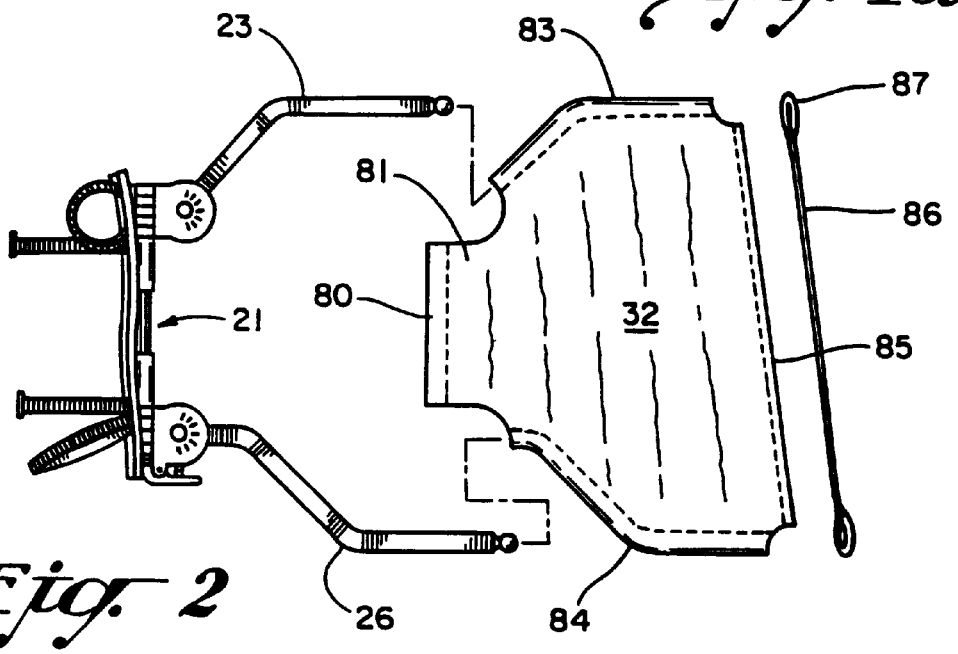
Fig. 2

BODY MOUNTED SAIL ASSEMBLY

BACKGROUND OF THE INVENTION

While the present human body sail assembly is intended for use with in-line roller skates, it certainly has other uses, and the prior art of body sails exemplifies body sails with alternative intended applications, and these prior devices are typified in the following United States and foreign patents:

| Invention | Patent No. | Issue Date |
|---|---|---|
| | UNITED STATES PATENTS | |
| Hardt | 2,018,062 | October 22, 1935 |
| Goldberg | 3,768,823 | October 30, 1973 |
| Alexander | 4,738,460 | April 19, 1988 |
| Boyden | 5,120,070 | June 9, 1992 |
| | FOREIGN PATENTS | |
| M. Hespel | French Patent No. 1,499,954 | Sept. 25, 1967 |

The Alexander, U.S. Pat. No. 4,738,460, shows a rather complex body sail mechanism for a bicycle rider in which the angle of the back mounted sail is controlled by one of the bicyclist's hands on operating lever 32. In this mechanism it is difficult for the operator to hold the sail in any particular angular position with respect to the body.

In Alexander, the sail pivots generally vertically about the axis defined by pins 20, 22, and the arms 46 are driven by gears 44 which extend and retract the sail as the arms move from a vertical position to a horizontal position and then back again.

Alexander's system also includes a tube for reefing the mainsail, as well as a ratchet mechanism shown in FIGS. 8, 9 and 10 that lock the sail in a predetermined reefed position.

It does not have any ratchet mechanism that controls movement of the entire sail about the axis defined by pins 20, 22, which is the location of the present ratchet mechanism.

The Boyden, U.S. Pat. No. 5,120,070, also shows a ratchet-type mechanism through the mainsail illustrated in FIG. 5 of his drawings, but the ratchet mechanism does not act directly on the mast and instead operates by holding main sheet 9 in position, which of course is nothing more than a sheet commonly found on sailboats.

The Goldberg, U.S. Pat. No. 3,768,823, shows a body-held sail for use by an ice skater, but it is not physically attached to the human body and only held by the user's shoulders and hands. It is somewhat relevant in that it shows a mechanism for stretching the body sail, but stretching is effected by pulling ribs 14*a* and 16 apart rather than by tensioning the ribs with a sail embedded line in a manner similar to the stringing motion in a recurve bow.

The French Brevet D'Invention No. 1,499,954, Delivre Sep. 25, 1967, discloses a body sail for a roller skater. The sail assembly swings by hand-held arms 39 and 40, and there does not appear to be any mechanical vertical pivot axis. The sail does include what appears to be lines along its upper periphery at 48 and 49 but does not clearly exert a tensioning force on ribs 43 and 46.

The Hardt, U.S. Pat. No. 2,018,062, discloses a body sail for a skater with particular emphasis on a mechanism for extending the sail by pivoting arms 9 outwardly from a vertically downward hanging collapsed position. The patent does not appear to be particularly pertinent otherwise.

In my U.S. Pat. No. 5,713,603, issued Feb. 3, 1998, I describe and claim a human body mounted sail assembly that includes a rotatable mast with upper and lower horizontal braces that swing with the mast. The sail is held taut by these braces which are placed in tension by the sail and a bow-like string at the sail leech. The mast, braces and sail assembly can be locked in any desired angular position relative to the human back by a pawl and ratchet mechanism on the base of the mast. The sail is collapsible using push-button quick release pivots at the inner ends of both the upper and lower braces.

While my prior design operates well and in fact is similar in basic design principles to my new, improved design described herein, it is a primary object of the present invention to improve the safety of my prior sail assembly, to reduce the manufacturing costs thereof, and to provide a much simpler sail assembly that is easier to manufacture and far simpler for the user to replace parts without the need for special tools or service centers.

It is, therefore, a primary object of the present invention to ameliorate the problems noted above in a human body mounted sail assembly and to provide one that is easier for the user to assemble and operate, one which collapses into a smaller envelope, and one that has enhanced safety features.

SUMMARY OF THE PRESENT INVENTION

In accordance with the present invention, an improved human body mounted sail assembly is provided including a flexible back contoured elastomeric base strapped to the user's back. Vertically spaced plastic mast pivot brackets are fixed to the base and rotatably support the mast, which includes a telescopic assembly designed to extend and contract with flexure of the sailor's back. A pair of booms or sail braces are pivoted to the ends of the mast to permit the sail to be collapsed. These sail braces are clamshelled to the mast in a way that permits the braces to disconnect for safety when the sailor falls, impacting the braces with sufficient force. The sail can be locked in any desired angular position by user operated interengaging frusto-conical gearing on the lower base bracket and the lower sail brace that automatically releases upon sufficient collision force. The mast assembly, the braces, and other parts are molded with high glass filled plastics to enhance the high strength and bendability of these parts for safety as well as durability.

All parts in the assembly are user replaceable to eliminate the need for either service centers or "ship in" manufacturer-provided service.

The assembly can be manufactured in multiple sizes for different torso sizes with changes only in the size of the mast, base and sail.

Finally, the leech of the sail is provided with a bow-like string with eyelets that are cinched to the sail braces with elastomeric rings that prevent the eyelets and bow string from falling off the braces when the sail is collapsed.

While in the exemplary embodiment, there are provided two sail assemblies; i.e., two masts and two sails, it should be understood that the principles of the present invention apply to a single sail assembly. Other objects and advantages will appear more clearly from the following detailed description.

BRIEF DESCRIPTION OF THE DRAWINGS

FIG. 1 is a side view of the human form with a present human body mounted sail assembly carried thereby;

FIG. 1*a* is an enlarged telescopic view of the interconnection between the sail bow string and the lower sail brace;

FIG. 2 is an exploded side view of the sail assembly illustrated in FIG. 1;

DETAILED DESCRIPTION OF THE PREFERRED EMBODIMENT

Figure 12:
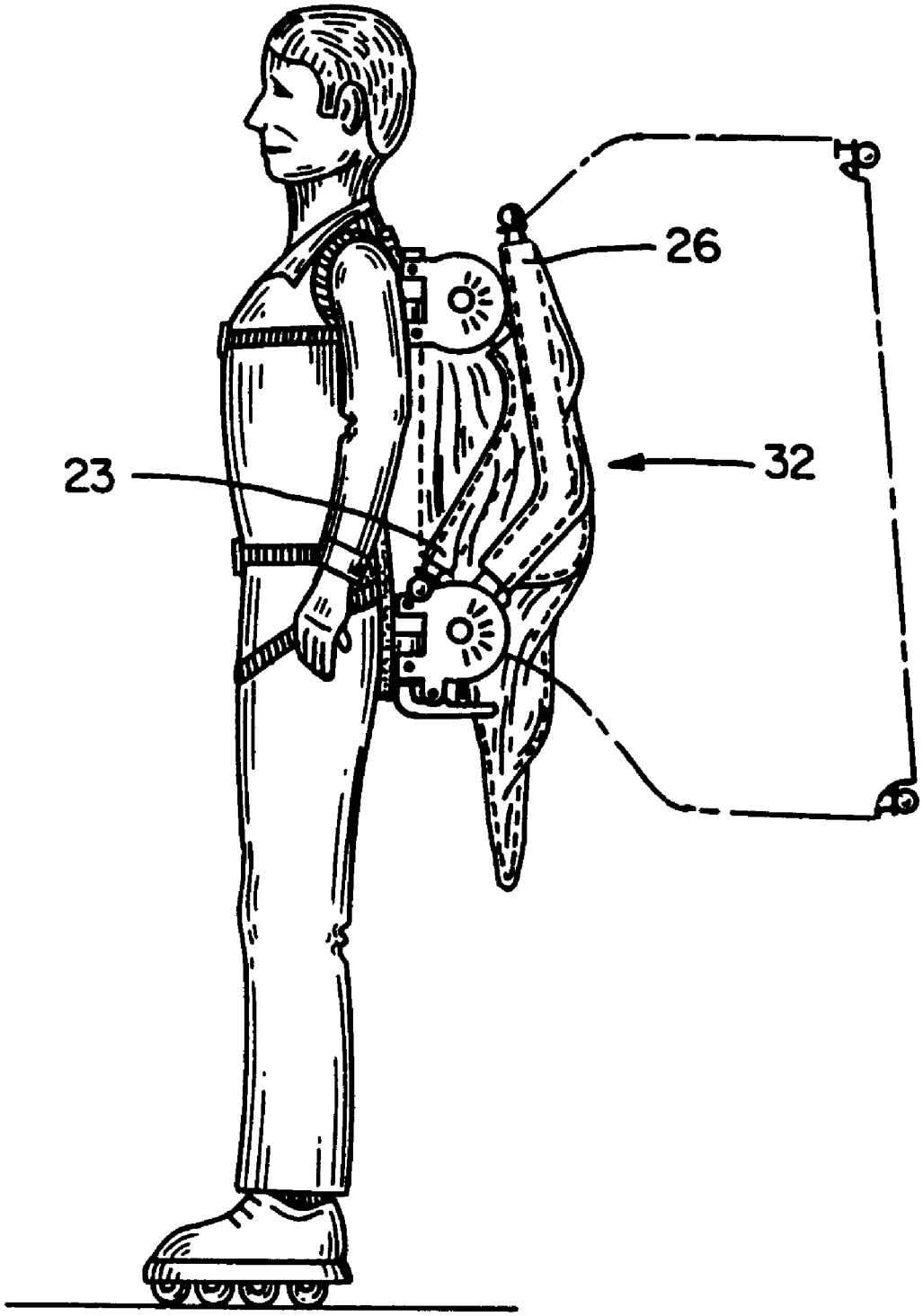
FIG. 12 is a side view of a human form with the present human body mounted sail assembly in its collapsed position.

Referring to the drawings and particularly FIGS. 1 to 7, the present body mounted sail assembly is designated generally by the reference numeral 10, and as shown in FIGS. 1 and 12, is attached to the back of a skater 11 by an upper strap assembly 12 threaded through upper slots 13 in a base 14 and a lower strap arrangement 16 threaded through lower slots 17 in base 14.

The sail assembly 10 is seen to generally include the base 14, base mounted bracket assemblies 19 and 20, a rotatable mast assembly 21, an upper sail brace or boom 23 attached to the upper end of the mast by a clamshell pivot assembly 24 and a lower sail brace 26 pivotally connected to the lower end of the mast assembly 21 by a lower clamshell pivot assembly 28, a frusto-conical gearing assembly 30 for locking the braces 23 and 24 in a fixed vertical plane, and a sail assembly 32.

It should be understood that the above description relates to the right sail assembly illustrated in the drawings and that the left sail assembly, unnumbered, is identical to the sail assembly described herein.

Figure 3:
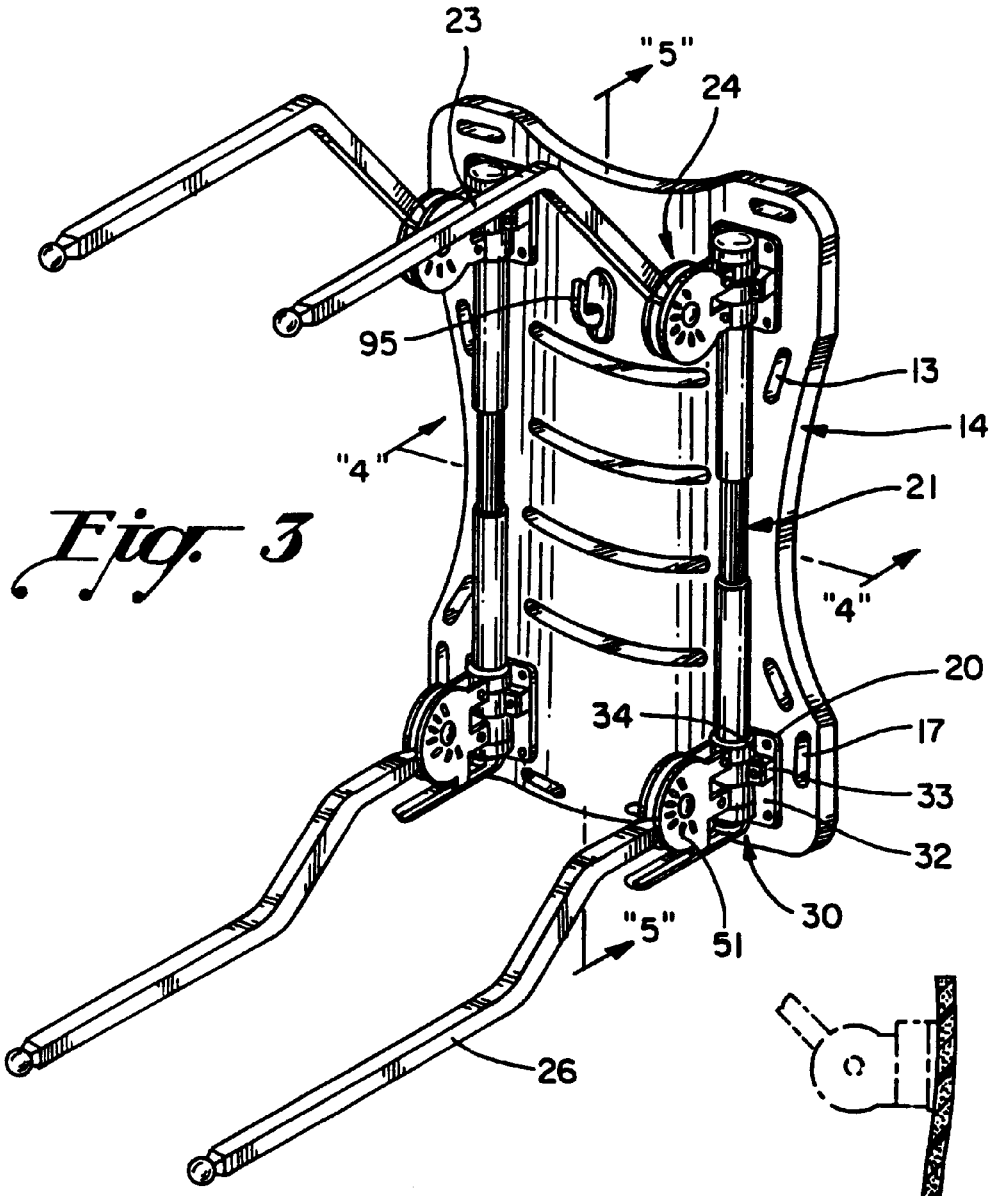
FIG. 3 is a rear perspective view of the present human body mounted sail assembly with the sails removed.
Figure 4:
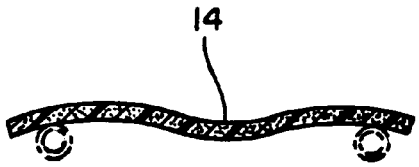
FIG. 4 is a cross section through the back mounted base taken generally along line 4—4 of FIG. 1.
Figure 5:
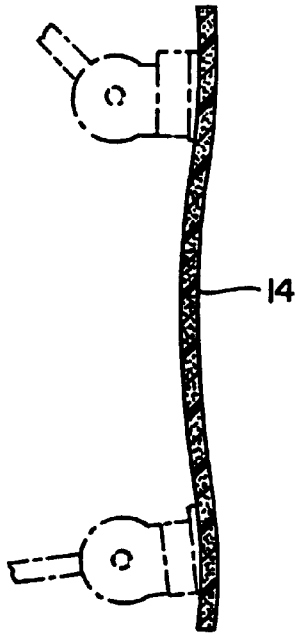
FIG. 5 is a vertical section through the back brace taken generally along line 5—5 of FIG. 3.
Figure 6:
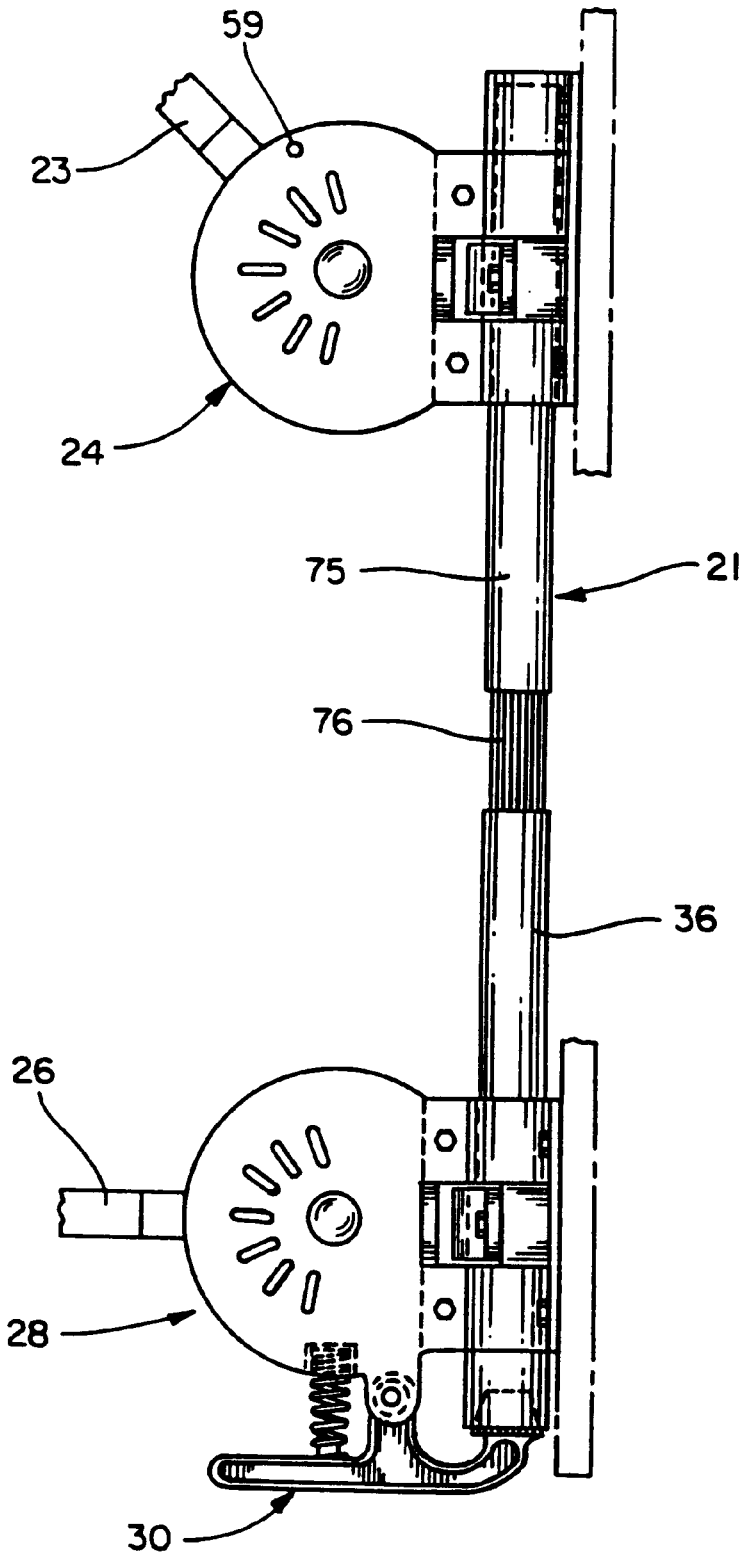
FIG. 6 is a side view, with the sail braces fragmented of the mast brackets, mast assembly, and clamshell pivot assemblies.

As seen in FIGS. 3, 4 and 5, the base 14 is a flexible molded elastomeric one-piece member that is sufficiently flexible so that it can bend and flex as the skater twists and bends his or her back.

Figure 7:
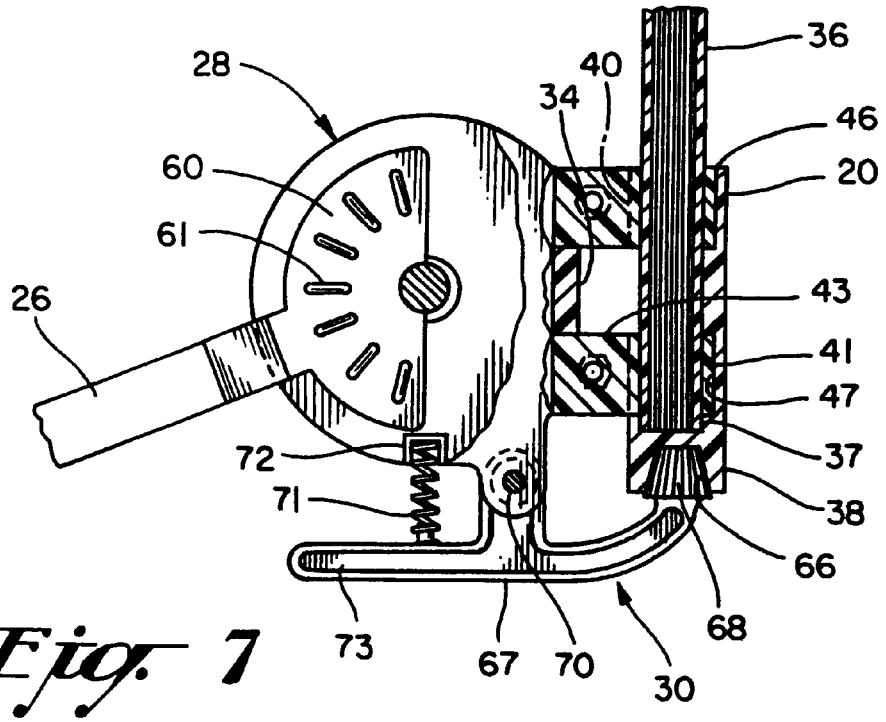
FIG. 7 is a partly fragmented view of the lower sail brace clamshell and frusto-conical gearing assembly.

The base brackets 19 and 20 are identical and as seen in FIGS. 3 and 7, include a flat back plate 32 having an integral boss 33 projecting outwardly therefrom. An arcuate bracket 34 is fixed to the boss 33 and forms a bearing for lower mast section 36. Also, the bracket 20 has a lower boss 38 with a bore 37 therein that rotatably receives the lower end of mast section 36, and the bracket 19 has an identical bore.

The lower clamshell assembly 28 includes a one-piece bracket that includes an upper sleeve 40 and a lower sleeve 41 with outwardly extending flanges 42 and 43. The annular sleeves 40 and 41 are glued to the lower mast section 36 and are rotatably mounted in semi-annular recesses 46 and 47 in the bracket 20.

Figure 9:
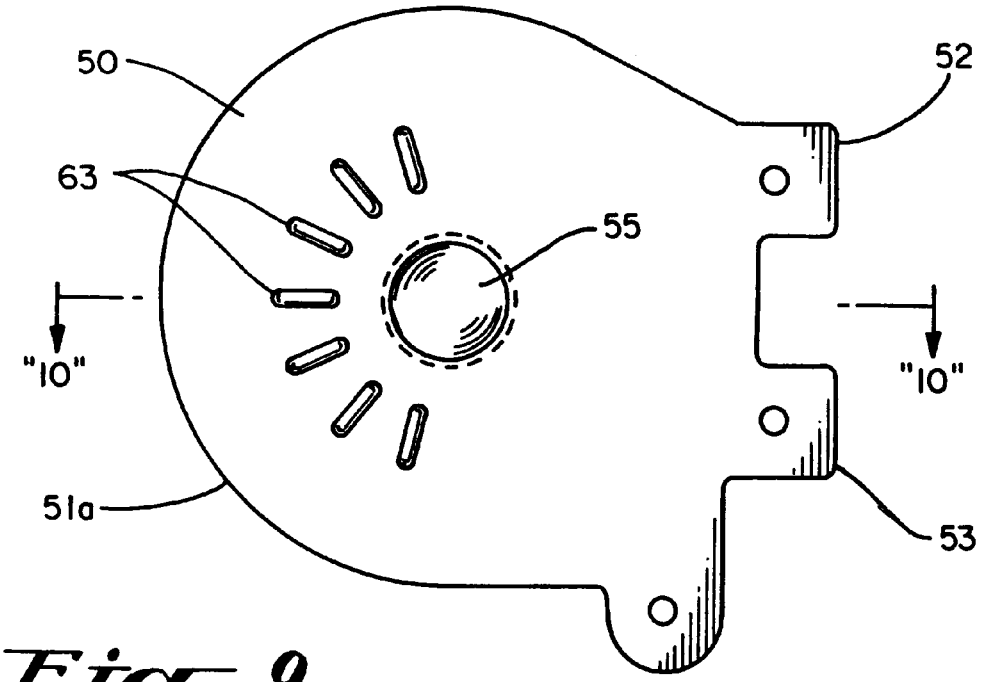
FIG. 9 is an inner side view of one of the clam-shell plates illustrated in FIGS. 3 and 7.
Figure 10:
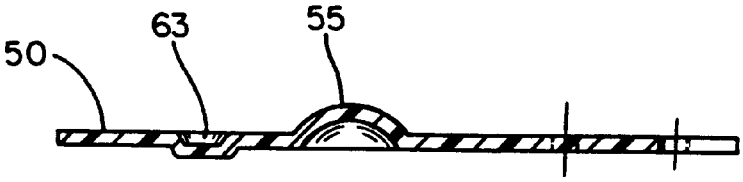
FIG. 10 is a longitudinal section through the clamshell plate taken generally along line 10—10 of FIG. 9.

The clamshell assembly 28 includes a pair of mirror image side plates 50 and 51, that as seen in FIG. 9, include a circular portion 51*a* with a pair of outwardly extending tabs 52 and 53 that are fastened to the sides of the flanges 42 and 43, as seen in FIGS. 3 and 7.

The side plates 50 have a spheroidal recess 55 that receives a ball joint 56 that has a central annular portion 57 and spheroidal ends 58 mounted in the spheroidal recesses 55. The ball joint 57 forms the pivot for the semi-annular plate portion 60 of the lower sail support 26, as seen clearly in FIGS. 11 and 12.

Figure 11:
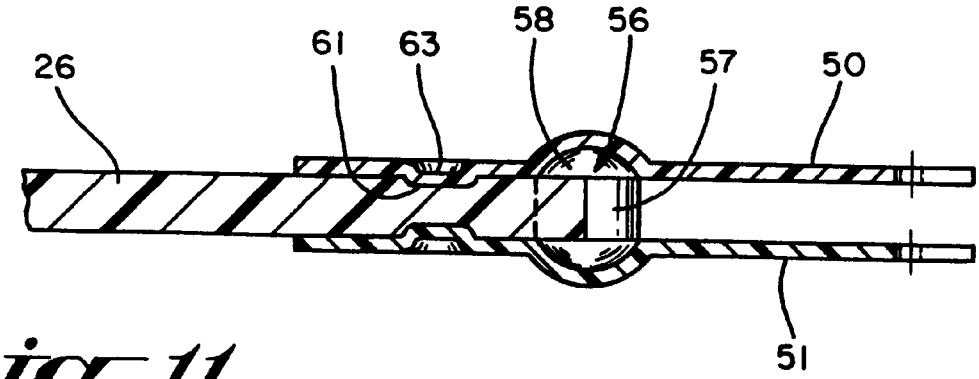
FIG. 11 is a cross section taken centrally through one of the clamshell plates showing the internal ball joint.

As seen in FIG. 11, both opposite sides of the semi-circular plate portion 60 have a plurality of radial grooves 61 integrally molded therewith that engage with complementary ribs 63 in the inside surfaces of the clamshell plates 50 and 51 to lock the sail brace 26 in its tensioned position, tensioning sail assembly 32, and also permit the sail support arms to be ratcheted to its collapsed position illustrated in FIG. 12.

Because the clamshell plates 50 and 51 are fixed together at the mast side of the plates, and because the plates 50 and 51 are constructed of plastic, they are sufficiently flexible so that upon sufficient impacting force upon the sail brace 26, the plates 50 and 51 will separate sufficiently so that the sail brace 26 can separate from the clamshell plates 50 and 51.

It should be understood, however, that because of this flexibility, after falling or impacting the sail brace with its subsequent separation, the user can easily reassemble the sail brace to the clamshell plates 50 and 51 and continue on the sailing journey.

It should also be understood that the upper clamshell assembly 24 and the mast connection are identical to that described with respect to the lower clamshell assembly 28 with the exception of the sail locking mechanism 30 so that a detailed description is unnecessary.

Also, pin 59 limits upward rotation of brace 23, so as not to allow sail 32 to block the visibility of the skater.

As seen more clearly in FIG. 7, the frusto-conical angular sail locking mechanism 30 is seen to include a frusto-conical gear 66 integrally molded in the lower end 38 of the one-piece lower bracket 20. A pivotal operating arm 67 has a complementary frusto-conical gear 68 integrally molded therewith that when engaged into the gear 66 locks the lower clamshell assembly 28 and the lower sail bracket 26 in a fixed angular position. The operator 67 is pivotally mounted to the clamshell plates 50 and 51 by a pin 70, and a spring 71 seated in a seat 72 in the plates 50 and 51 biases the operator 67 in a direction to engage the gears 66 and 68.

The operator 67 has a handle portion 73 that is in the same plane as the lower clamshell assembly and in a position to be easily operated by the skater's hand.

The teeth on the gears 66 and 68 are curved in cross section, and because of this and the fact that the gearing is frusto-conical in design, the mast as well as the sails and the clamshell assemblies, are permitted to pivot about the axis of the mast upon collision because the gearing 66 and 68 will separate upon sufficient lateral force applied to the supports 23 and 26, permitting relative rotation between gears 66 and 68.

Figure 8:
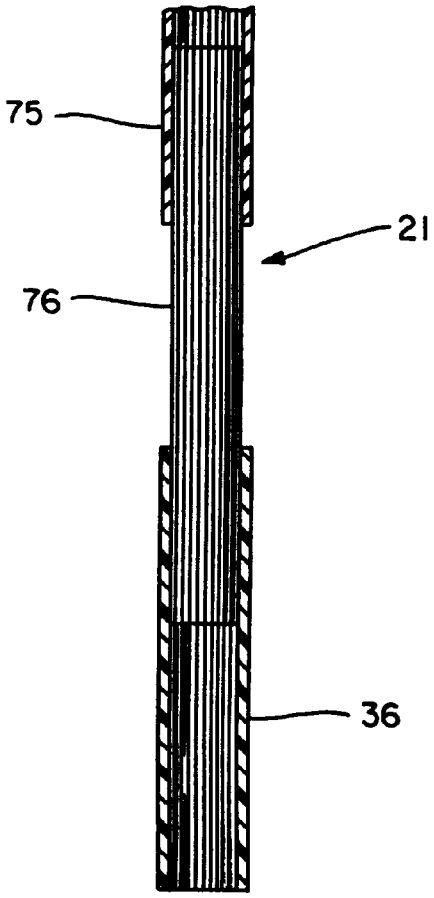
FIG. 8 is a fragmented vertical section of the central portion of the mast assembly.

As seen in FIG. 8, the mast assembly includes an upper section 75, the lower section 36, and an intermediate section 76. The upper and lower sections 75 and 36 have internal splines and the central section 76 has external splines, mating with the splines on the upper and lower section, and this design enables the mast assembly to extend and contract with flexure of the flexible base 14 as the skater twists and bends.

As seen in FIGS. 1, 1*a* and 2, sail assembly 32 has a pocket 80 at its left portion 81 that sleeves around mast assembly 21, has a top pocket 83 received on upper sail brace 23, and a foot pocket 84 received on lower brace 26.

Sail assembly 32 also has a leech pocket 85 that receives a bow-like string 86 with eyelets 87 at both ends that fit over a ball 88 on the ends of the upper and lower sail braces 23 and 26. As seen in FIG. 1*a*, the outer ends of the sail braces 23 and 26 are rectangular in configuration and have outwardly tapered ends 89 adjacent the balls 88 providing a reduced and narrow portion 90 into which the eyelets 87 fit.

A small elastomeric ring 91 is fitted over the bow-like string 86 at each end thereof and it is fitted quite tightly there-around so that the user can cinch the eyelet 87 closely around the narrow portion 90. This prevents the eyelets from falling off the balls 88 when the sail is in its collapsed and untensioned position illustrated in FIG. 12, or in any untensioned position of the sail support arms 23 and 26.

As seen in FIG. 12, the sail assembly is manipulated to its collapsed position by rotating and ratcheting the lower sail brace 26 upwardly, and the upper sail brace 23 downwardly closely adjacent the user's back and the interengaging grooves 61 and ribs 63 hold the brace arms in these collapsed positions.

As seen in FIG. 3, a plastic hook 95 is fixed to the upper portion of the base 14 midway between the masts 21 so the skater can carry articles such as a backpack, water bottle or clothing, freeing the skater's hands and arms for skating and sailing manipulations.

What is claimed is:

1. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, and means for disconnecting the sail support from the mast in the event the user falls in a manner to strike the sail support.

2. A human body sail assembly as defined in claim 1, wherein the means for disconnecting the sail support from the mast includes a clamshell assembly with two generally vertical side plates releasably holding the sail support therebetween.

3. A human body sail assembly as defined in claim 2, wherein the sail support has a planar plate mounted between the clamshell assembly side plates, said sail support and planar plate being pivotal about a generally horizontal axis through the side plates, said side plates and planar plate having interengaging grooves and ribs to releasably lock the sail support in a plurality of angular positions about said horizontal axis relative to the side plates.

4. A human body sail assembly as defined in claim 2, wherein the side plates are spaced apart and fastened together only at one side thereof, said side plates being somewhat flexible so they spread apart to release the sail support upon sufficient impact force.

5. A human body sail assembly for sport and transportation, comprising: a base to be attached to the user with back supported portions, mast bracket means for supporting a mast fixed to the back support portions of the base, at least one mast having an axis carried by the bracket means, a sail support extending radially outward from the mast and rotatable about an axis substantially coaxial with the mast axis, a sail carried by said sail support extending outwardly therewith, and means between said sail support and the base for indexing and releasably locking the sail support and sail about the mast axis in a plurality of fixed positions with respect to the base, and for setting the sail in a variety of angular positions in generally vertical planes including a first toothed member generally coaxial with the mast and fixed with respect to the mast bracket means, and shiftable second toothed member generally coaxial with the mast and carried by the sail support and selectively engagable with the first toothed member to selectively lock the sail in a desired angular position.

6. A human body sail assembly as defined in claim 1, wherein said first toothed member is a first frusto-conical gear and said second toothed member is a complementary second frusto-conical gear, a manual operator for said second frusto-conical gear, and means biasing said second frusto-conical gear toward said first frusto-conical gear.

7. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, means for disconnecting the sail support from the mast in the event the user falls in a manner to strike the sail support, and means between said sail support and the base for indexing and releasably locking the sail support and sail about the mast axis in a plurality of fixed positions with respect to the base, and for setting the sail in a variety of angular positions in generally vertical planes including a first toothed member generally coaxial with the mast and fixed with respect to the mast bracket means, and shiftable second toothed member carried by the sail support and selectively engageable with the first toothed member to selectively lock the sail in a desired angular position.

8. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, means for disconnecting the sail support from the mast in the event the user falls in a manner to strike the sail support, means between said sail support and the base for indexing and releasably locking the sail support and sail about the mast axis in a plurality of fixed positions with respect for the base, and for setting the sail in a variety of angular positions in generally vertical planes including a first gear toothed member generally coaxial with the mast and fixed wit respect to the mast bracket means, and shiftable second toothed member carried by the sail support and selectively engagable with the first toothed member to selectively lock the sail in a desired angular position, said means for disconnecting the sail support from the mast including a clamshell assembly with two generally vertical side plates releasably holding the sail support therebetween, said sail support having a planar plate mounted between the clamshell assembly side plates, said sail support and planar plate being pivotal about a generally horizontal axis through the side plates, said side plates and planar plate having interengaging groves and ribs to releasably lock the sail support in the desired angular position about said horizontal axis relative to said side plates.

9. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, and means between said sail support and the base for indexing and releasably locking the sail support and sail about the mast axis in a plurality of fixed positions with respect to the base, and for setting the sail in a variety of angular positions in generally vertical planes including means for releasing the means locking the sail support in the event of a user fall striking the sail support.

10. A human body sail assembly as defined in claim 9, wherein the means for indexing and releasably locking the sail includes a first toothed member generally coaxial with the mast and fixed with respect to the mast bracket means, and shiftable second toothed member carried by the sail support and selectively engageable with the first toothed member to selectively lock the sail in a desired angular position, said first toothed member being a first frusto-conical gear and said second toothed member being a complementary second frusto-conical gear, a manual operator for said second frusto-conical gear, and means biasing said second frusto-conical gear toward said first frusto-conical gear.

11. A human body sail assembly as defined in claim 10, wherein the means for indexing and releasably locking the sail includes means for releasing the means locking the sail support in the event of a user fall striking the sail support.

12. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, and means between said sail support and the base for indexing and setting the sail in a variety of angular positions in generally vertical planes, said base including a contoured flexible panel adapted to be releasably attached to the user's back, a second sail support extending radially outward from the mast and rotatable about an axis substantially coaxial with the mast axis, said mast being extendible to accommodate flexure in the contoured flexible panel as the user's back flexes.

13. A human body sail assembly as defined in claim 12, wherein the mast includes at least two splined telescopic sections to accommodate said extendible characteristic.

14. A human body sail assembly for sport and transportation, comprising: a base adapted to be attached to the user with back supported portions, mast bracket means for supporting a mast fixed to the back supported portions of the base, at least one mast having an axis carried by the bracket means, a first sail support extending radially outward from the mast and rotatable about an axis substantially coaxial with the mast axis, means for indexing and for setting the sail in a variety of angular positions in generally vertical planes, a second sail support extending radially outwardly from the mast and rotatable about an axis substantially coaxial with the mast axis, a sail having a leech carried by the sail supports and extending outwardly therewith, a taut line carried by the leech of the sail having eyelets at the ends thereof strung to the first and second sail supports, said sail supports being pivotal, and means for preventing the eyelets of the taut line from falling off the first and second sail supports when they do not tension the sail.

15. A human body sail assembly as defined in claim 14, wherein the means for preventing the eyelets from falling off the first and second sail supports includes an elastomeric ring around the eyelets cinched to the sail supports.

16. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, said sail support being pivotal relative to the mast to raise and collapse the sail, and indexing means between the sail support and the mast to hold the sail support in a sail raised position and a sail collapsed position.

17. A human body sail assembly as defined in claim 16, wherein the sail support has a planar plate mounted between the clamshell assembly side plates, said sail support and planar plate being pivotal about a generally horizontal axis through the side plates, said side plates and planar plate having interengaging grooves and ribs to releasably lock the sail support in a plurality of angular positions about said horizontal axis relative to the side plates.

18. A human body sail assembly for sport and transportation, comprising: a base adapted to be attached to the user with back supported portions, mast bracket means for supporting a mast fixed to the back supported portions of the base, at least one mast having an axis carried by the bracket means, a first sail support extending radially outward from the mast and rotatable about an axis substantially coaxial with the mast axis, a sail carried by said sail support extending outwardly therewith, for indexing and for setting the sail in a variety of angular positions in generally vertical planes, a second sail support extending radially outward from the mast and rotatable about an axis substantially coaxial with the mast axis, means for collapsing the sail supports and sail in a compact configuration including means for collapsing the first sail support downwardly and means for collapsing the second sail support upwardly in a position adjacent the collapsed first sail support.

19. A human body sail assembly for sport and transportation, comprising: a base adapted to be attached to the user with back supported portions, mast bracket means for supporting a mast fixed to the back supported portions of the base, at least one mast having an axis carried by the bracket means, a sail support extending radially outward from the mast and rotatable about an axis substantially coaxial with the mast axis, a sail carried by said sail support extending outwardly therewith, means for setting the sail in a variety of angular portions in generally vertical planes, said sail support being pivotal relative to the mast, and means to limit pivotal movement of the sail support relative to the mast.

20. A human body sail assembly as defined in claim 19, wherein the means to limit pivotal movement is a pin means.

21. A human body sail assembly for sport and transportation, comprising: a base adapted to be attached to the user with back supported portions, mast bracket means for supporting a mast fixed to the back supported portions of the base, two spaced masts each having an axis carried by the bracket means, a sail support extending radially outward from the mast and rotatable about an axis substantially coaxial with the mast axis, a sail carried by said sail support extending outwardly therewith, means for setting the sails in a variety of angular portions in generally vertical planes, and means fixed to the base between the masts for carrying a variety of articles.

* * * * *